US011460279B2

(12) United States Patent
Masinelli et al.

(10) Patent No.: US 11,460,279 B2
(45) Date of Patent: Oct. 4, 2022

(54) FRAGMENTING BULLET

(71) Applicant: Olin Corporation, St. Louis, MO (US)

(72) Inventors: Kyle Adam Masinelli, Oxford, MS (US); Taylor B. Patton, Oxford, MS (US)

(73) Assignee: Olin Corporation, St. Louis, MO (US)

( * ) Notice: Subject to any disclaimer, the term of this patent is extended or adjusted under 35 U.S.C. 154(b) by 0 days.

(21) Appl. No.: 16/038,149

(22) Filed: Jul. 17, 2018

(65) Prior Publication Data

US 2019/0017790 A1 Jan. 17, 2019

Related U.S. Application Data

(60) Provisional application No. 62/533,643, filed on Jul. 17, 2017.

(51) Int. Cl.

| | |
|---|---|
| ***F42B 12/74*** | (2006.01) |
| ***F42B 12/36*** | (2006.01) |
| ***F42B 12/34*** | (2006.01) |

(52) U.S. Cl.

CPC ..... *F42B 12/367* (2013.01); *F42B 12/34* (2013.01); *F42B 12/74* (2013.01)

(58) Field of Classification Search

CPC ..... F42B 12/34; F42B 12/74

See application file for complete search history.

(56) References Cited

U.S. PATENT DOCUMENTS

| | | | | |
|---|---|---|---|---|
| 4,947,755 | A * | 8/1990 | Burczynski | F42B 12/34 102/501 |
| 8,393,273 | B2 | 3/2013 | Weeks et al. | |
| 2010/0018430 | A1* | 1/2010 | Masinelli | F42B 12/34 102/507 |
| 2010/0275804 | A1* | 11/2010 | Trivette | F42B 5/30 102/448 |

* cited by examiner

*Primary Examiner* — J. Woodrow Eldred

(74) *Attorney, Agent, or Firm* — Harness, Dickey & Pierce, P.L.C.

(57) ABSTRACT

A fragmenting bullet has a metal core having a generally cylindrical rear section and a tapering forward section, a plurality of spaced slots in the forward section forming a plurality of prongs. A metal jacket encloses and substantially conforms to the core. The jacket has an open forward end, and a plurality of lines of weakness in the portion of the jacket over the forward section of the core.

21 Claims, 6 Drawing Sheets

FRAGMENTING BULLET

CROSS-REFERENCED APPLICATION

This application claims priority to U.S. provisional application Ser. No. 62/533,643 filed on Jul. 17, 2017. The disclosure of the above-referenced application is incorporated herein by reference in its entirety.

FIELD

This invention relates to bullets, and in particular to fragmenting bullets.

BACKGROUND

This section provides background information related to the present disclosure which is not necessarily prior art.

Bullets used for hunting small animals—colloquially referred to as varmints—are usually designed to rapidly fragment upon hitting the target, to rapidly transfer the kinetic energy of the bullet to the target. This is surprisingly challenging for the design of low and no lead bullets. Lead bullets are of high mass and high malleability, rapidly transferring kinetic energy to the target. Most reasonably substitute metals are much harder and tend to penetrate the target, rather than efficiently transfer kinetic energy to it. The conventional solution in small caliber bullets, such as 0.22 caliber bullets, is to make the bullet, or at least the bullet's core, from of compressed metal powder which can disintegrate upon striking the target. One example of such bullet is disclosed in U.S. Pat. No. 8,393,273, incorporated herein by reference.

Embodiments of the present invention provide a fragmenting bullet of simple construction that maintains its integrity upon being fired, but which rapidly fragments upon striking a target. Several of these embodiments are of simple construction, and are relatively easy and inexpensive to manufacture.

A preferred embodiment of a bullet constructed according to the principles of this invention comprises a metal core having a generally cylindrical rear section and a tapering forward section. There are a plurality of spaced slots in the forward section forming a plurality of prongs. A metal jacket encloses and substantially conforms to the core. The jacket can have an open forward end, and a plurality of lines of weakness, for example six, equally spaced around the circumference of the jacket, and extending from the open forward end toward the cylindrical rear section.

The core is preferably made of a cast metal, and more preferably of cast zinc or zinc alloy. The jacket preferably comprises a copper or copper alloy.

There are preferably four spaced slots in the forward section of the core, forming four prongs. There is preferably also an axially extending passage extending from the front of the core at least partway through the forward section. The rearward end of the axially extending passage is preferably further from the rear of the core than the rearward end of the slots. However, the rearward end of the axially extending passage is forward of the rearward end of the tapering forward section of the core.

In a most preferred embodiment of this invention a fragmenting bullet comprises a cast zinc core having a generally cylindrical rear section and a tapering forward section. A generally axially extending passage extends from the front of the core at least partway through the forward section. Four equally spaced radial slots are formed in the forward section, extending to the passageway, forming four prongs. A copper alloy jacket encloses and substantially conforms to the core. The jacket has an open forward end, and a plurality of lines of weakness equally spaced around the jacket, extending from the open forward end toward the rear end.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENT

Example embodiments will now be described more fully with reference to the accompanying drawings.

Figure 1:
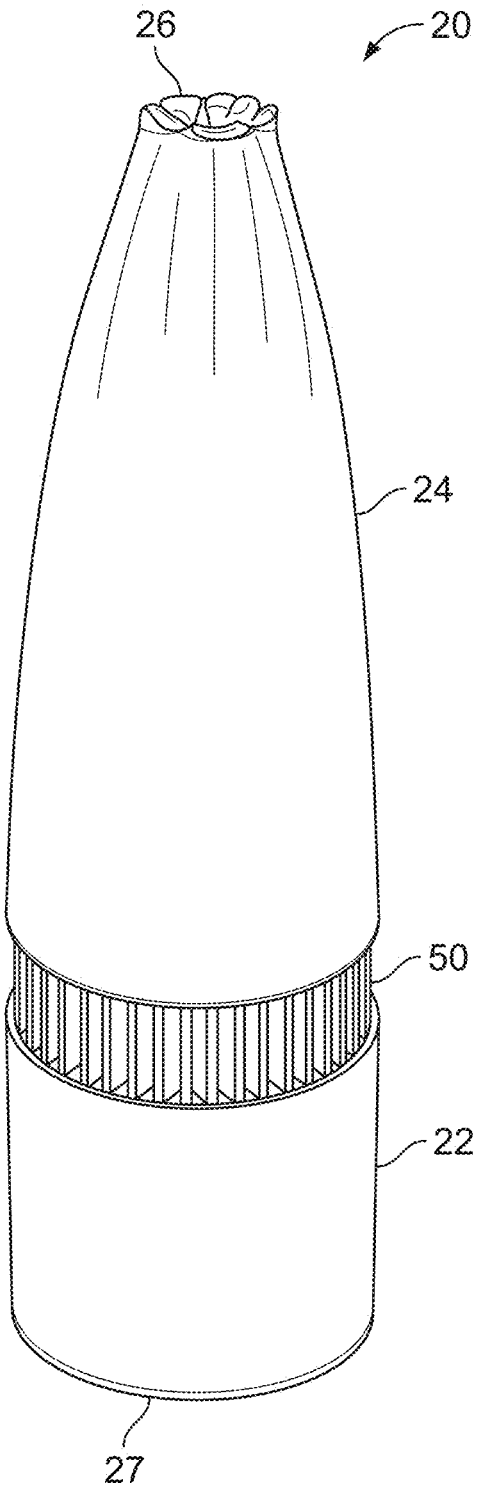
FIG. 1 is a perspective photographic view of a preferred embodiment of a bullet constructed according to the principles of this invention.
Figure 2:
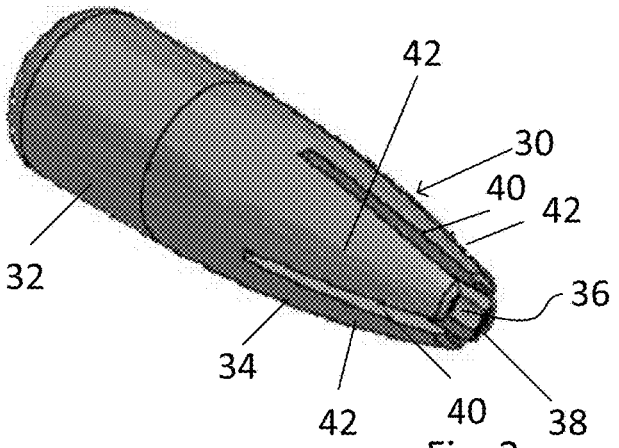
FIG. 2 is a perspective view of a three dimensional model of the core of the bullet of the preferred embodiment.
Figure 4:
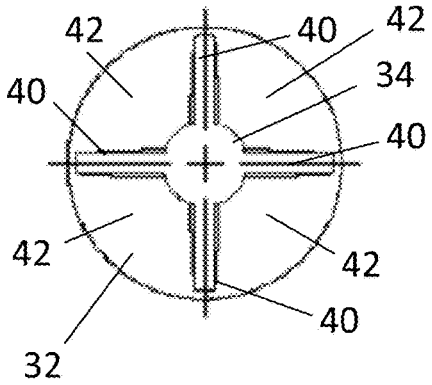
FIG. 4 is a front end elevation view of the core of the bullet of the preferred embodiment.

Embodiments of the present invention provide a fragmenting bullet of simple construction that maintains its integrity upon being fired, but which rapidly fragments upon striking a target. A preferred embodiment of a bullet constructed according to the principles of this invention is indicated generally as 20 in FIGS. 1-8. As shown in FIG. 1 Bullet 20 has a generally cylindrical rear section 22, and tapering forward section 24, and an open forward end 26, and a closed rear or tail end 28. The bullet comprises a metal core 30 having a generally cylindrical rear section 32 and a tapering forward section 34. There is preferably an axially extending passage 36 extending from the front 38 of the core 30 at least partway through the forward section 34, and plurality of spaced slots 40 in the forward section forming a plurality of prongs 42.

Figure 3:
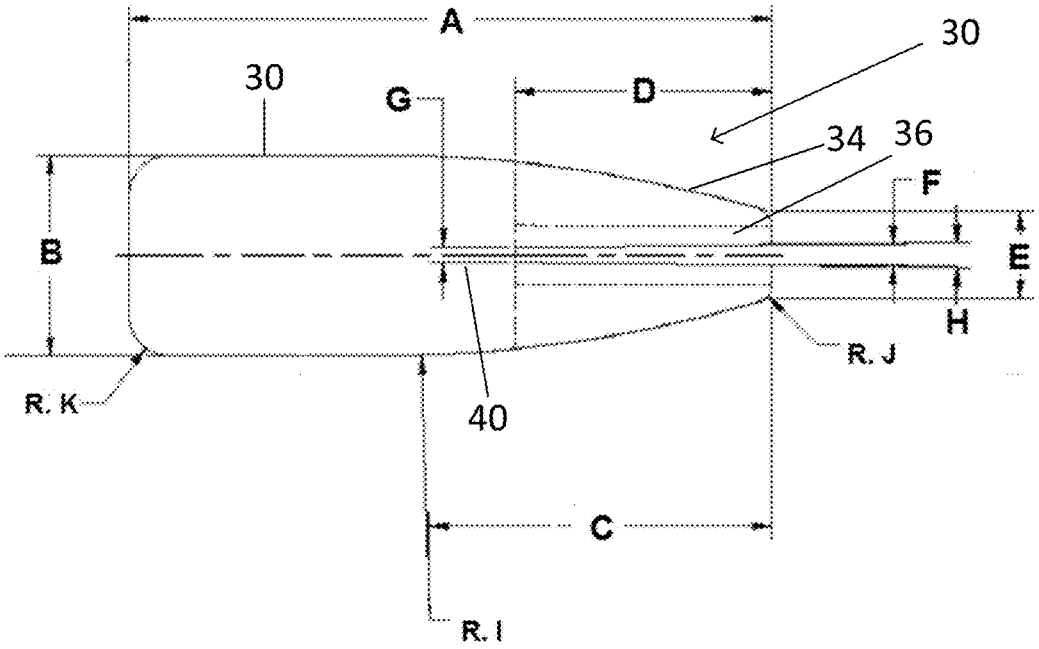
FIG. 3 is a longitudinal cross sectional view of the core of the bullet of the preferred embodiment.

The width of the slots preferably tapers from the forward end of the slot toward the rearward end of the slot. This taper is preferably between about 0.5° and 2.5°, and more preferably about 1°. As best shown in FIG. 3, the slots 40 extend further toward the rearward end of the core than the axial passage 36. Of course the slots 40 and axial passage 36 could be the same length, or the axial passage could be longer than the slots.

A metal jacket 44 encloses and substantially conforms to the core 30. The jacket 44 can have an open forward end 46, corresponding to the open forward end 26 of the bullet 20, and a plurality of lines of weakness 48. In this preferred embodiment there are six lines of weakness, extending from the open forward end, over the tapered forward portion of the jacket toward the generally cylindrical rear portion of the jacket. There could be fewer or more lines of weakness 48. The lines of weakness 48 are preferably equally spaced around the circumference of the jacket, although they could be arranged in some other manner.

The core is 30 preferably made of a cast metal, and more preferably of cast zinc or zinc alloy, such as Zamak #3, whose nominal composition is:

| Al | Cu | Mg | Fe | Pb | Cd | Sn | Zn |
|---|---|---|---|---|---|---|---|
| 3.5-4.3 | 0.25 max | 0.02-0.05 | 0.1 | 0.005 (max) | 0.004 (max) | 0.003 (max) | Bal. |

The jacket 40 preferably comprises a copper or copper alloy, such as UNS #C22000 and C22600

There are preferably four spaced slots 40 in the forward section of the core 30, forming four prongs 42. While in this preferred embodiment there are four slots 40 forming four prongs 42, there could of course be fewer slots (for example two slots forming two prongs, or three slots forming three prongs), or more slots (for example five, six, seven, eight or more slots). However, four slots and four prongs appears to provide an effective balance between maintaining the mass of the core, and providing prongs of a size that reliably fragment from the remainder of the core upon impact with the target. The axially extending passage 36 and the slots 40 cooperate to divide the forward portion of the core into four prongs 42 that fragment upon impact with a target. The rearward end of the axially extending passage 36 is preferably further from the rear of the core 30 than the rearward end of the slots 42. The rearward end of the axially extending passage 36 is preferably forward of the rearward end 50 of the tapering forward section of the core 30, while the rearward end of the slits is preferably at or closely adjacent to the rearward end of the tapering forward section of the core.

In a most preferred embodiment of this invention a fragmenting bullet comprises a cast zinc core having a generally cylindrical rear section 32 and a tapering forward section 34. The copper alloy jacket 44 encloses and substantially conforms to the core 30. The open forward end of the jacket 40 is generally aligned with the axially extending passage 38.

Operation

A preferred embodiment of a bullet according to the principles of this invention in 22 caliber might have the following dimensions (referring to FIG. 2):

| Description | Reference | Dimension in a .22 caliber bullet | Dimension in a .243 caliber bullet |
|---|---|---|---|
| Overall core length | A | 0.625 inches (1.59 cm) | 0.800 inches (2.03 cm) |
| Diameter at rear of core | B | 0.1961 (0.485 cm) | 0.2000 Inches (0.508 cm |
| Length of forward portion of core | C | 0.3804 inches (0.966 cm) | 0.4427 inches (1.124 cm) |
| Depth of axial Passage | D | 0.250 inches (0.635 cm) | 0.360 inches (0.9144 cm) |
| Diameter at front of core | E | 0.085 inches (0.216 cm) | 0.09068 inches (0.2303 cm) |

-continued

| Description | Reference | Dimension in a .22 caliber bullet | Dimension in a .243 caliber bullet |
|---|---|---|---|
| Width of Slot at end of slot | F | 0.020 inches (0.051 cm) | 0.020 inches (0.051 cm) |
| Width of slot at root of slot | G | 0.015 inches (0.381 cm) | 0.015 inches (0.381 cm) |
| Taper of slit | H | 1° | 1° |

-continued

| Description | Reference | Dimension in a .22 caliber bullet | Dimension in a .243 caliber bullet |
|---|---|---|---|
| Radius of curvature of forward portion | Radius I | 1.33 inches (3.38 cm) | 1.820 inches (4.623 cm) |
| Radius of curvature of forward end of core | Radius J | 0.01 inches (0.0254 cm) | 0.01 inches (0.0254 cm) |
| Radius of curvature of rearward end of core | Radius K | 0.04 inches (0.102 cm) | 0.03 inches (0.0762 cm) |

Figure 5:
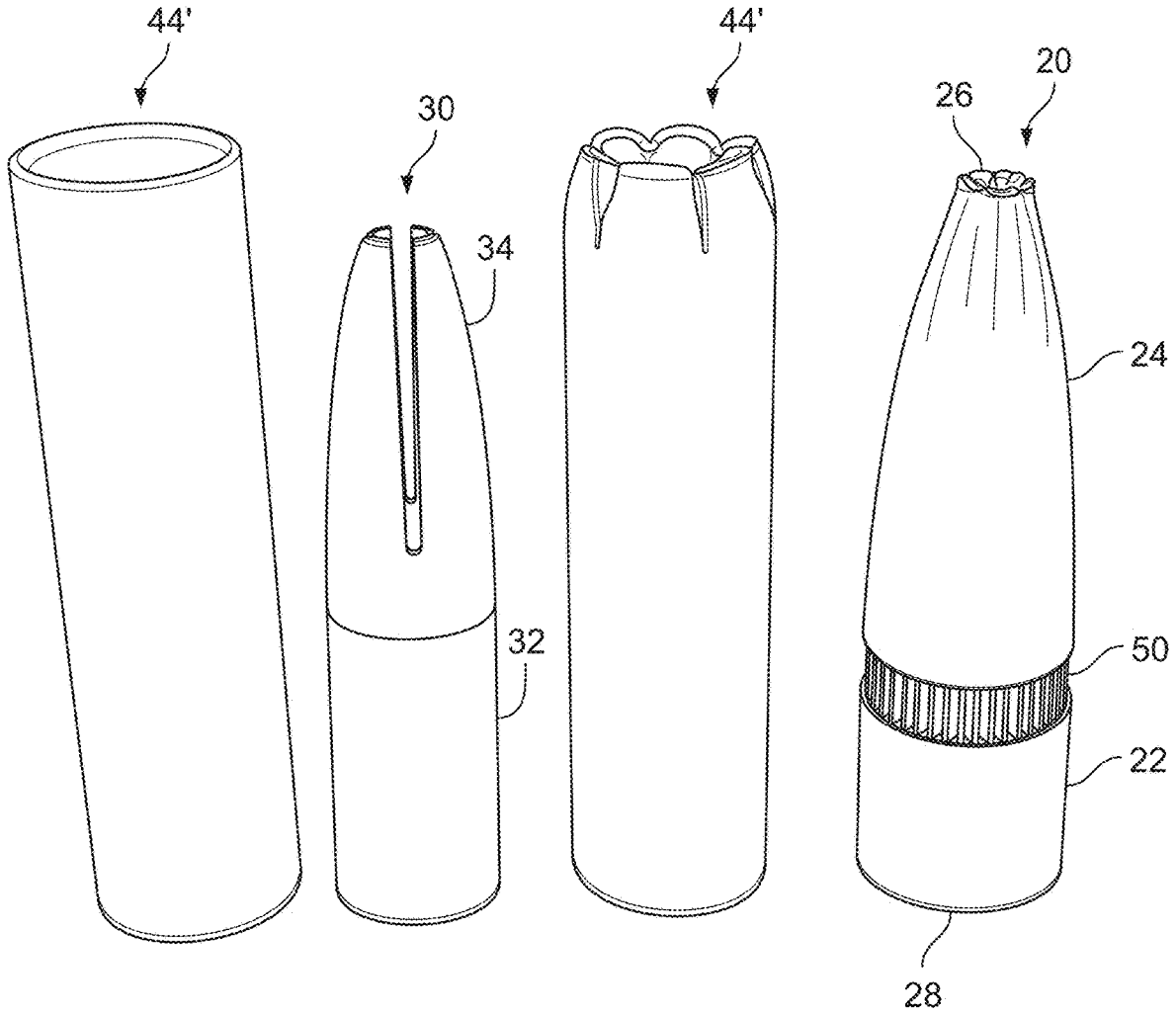
FIG. 5 is a photographic view showing the drawn cup-shaped jacket preform, the cast core, and a finished bullet of the preferred embodiment made therefrom.

As shown in FIG. 5, the bullet is preferably formed by casting a core 30, forming a jacket by drawing a cup-shaped jacket preform 44', depositing the core in the cup-shaped jacket preform, scoring the rim of the cup-shaped jacket preform to form the lines of weakness, and swaging the cup-shaped jacket preform around the core.

The bullet 20 preferably has a belt of knurling 50 in the jacket that helps to temporarily hold the core 30 in place. This knurling 50 is preferably located at or near the juncture between the forward and rearward portions 22 and 24 of the bullet.

Figure 6:
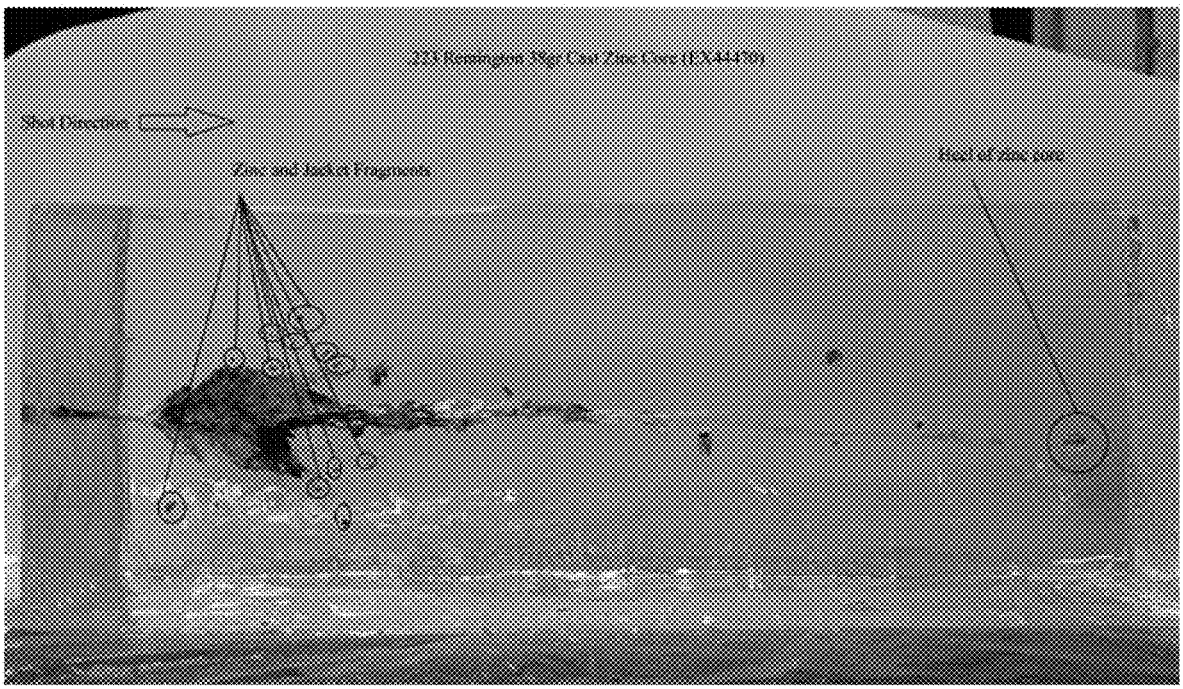
FIG. 6 is a side elevation view of a block of ballistic gelatin showing the fragmentation of the bullet of the preferred embodiment.
Figure 7:
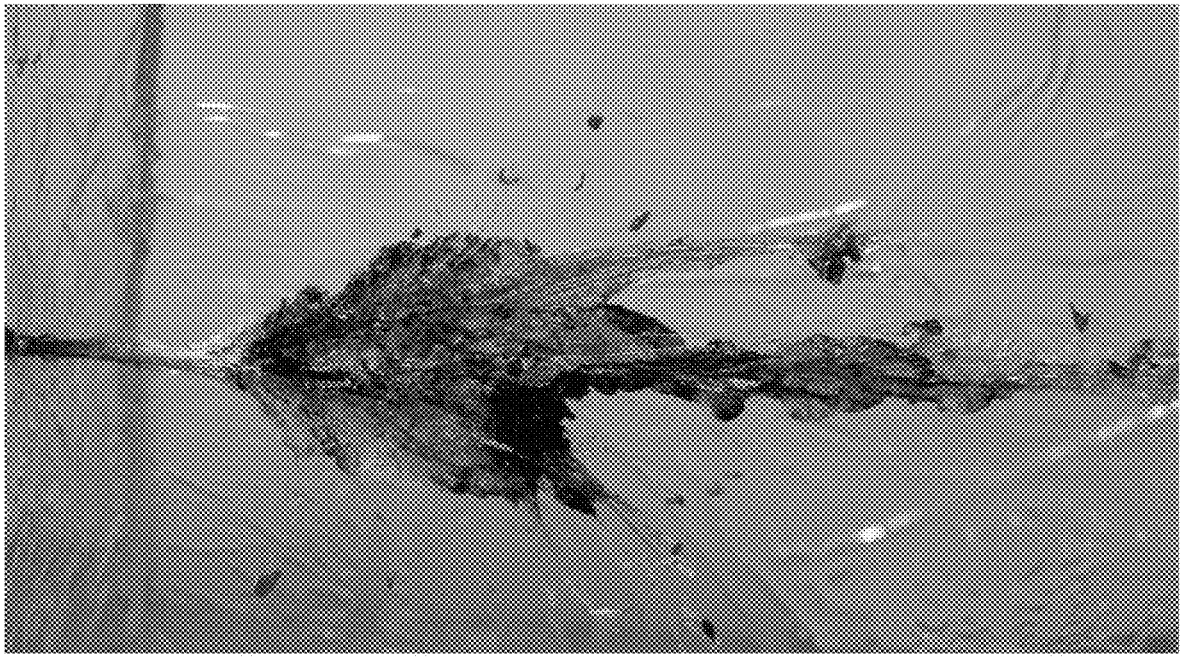
FIG. 7 is a side elevation view of a block of ballistic gelatin showing the fragmentation of the bullet of the preferred embodiment.
Figure 8:
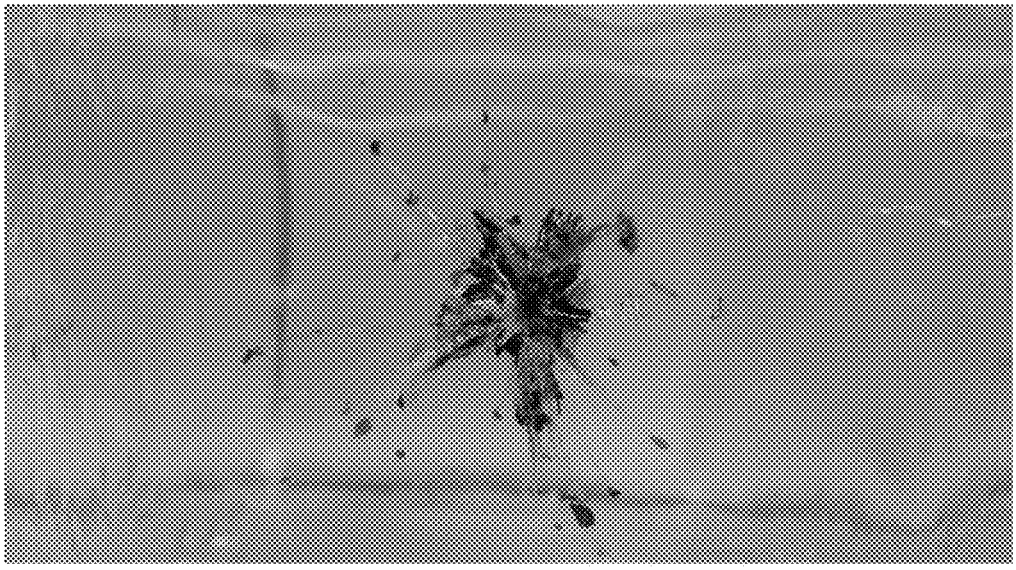
FIG. 8 is an entry end a side elevation view of a block of ballistic gelatin showing the fragmentation of the bullet of the preferred embodiment.

This bullet 20 of the preferred embodiment allows for rapid fragmentation of the jacket and zinc segments upon impact with the intended target. After the initial energy deposit and fragmentation of the jacket and zinc segments, the base core of the cast zinc continues to penetrate the target. This is shown in FIGS. 6-8. FIGS. 6 and 7 are side views of a block of ballistic gelatin (simulating tissue) showing how the bullet of the preferred embodiment breaks up into pieces of jacket material and pieces of core material, however a significant mass, from the rearward section 32 of the core travels an appreciable distance in the target. However, substantially all of the kinetic energy of the bullet is transferred to the target, and a substantial portion of it very quickly, as evidenced by the close proximity of the fragments to the entry side. FIG. 8 is an end view of the block from the entry side, also showing the fragmentation of the bullet of the preferred embodiment.

| Caliber | Velocity (fps) | Distance (ft) | Penetration (in) | % Mass (Estimate) |
|---|---|---|---|---|
| .223 Remington | 3800 | 10 | 0-7 | 30-50 |
| | | | 7-13 | 5-10 |
| | | | 13-16 | 40-65 |

-continued

| Caliber | Velocity (fps) | Distance (ft) | Penetration (in) | % Mass (Estimate) |
|---|---|---|---|---|
| .243 Winchester | 3900 | 10 | 0-7 | 45-65 |
| | | | 7-13 | 5-10 |
| | | | 13-16 | 30-45 |

The table above compares a prior art lead free bullet (the 0.223 Remington) with a bullet constructed according to the principles of the present invention (the 0.243 Winchester) fired into ballistic gelatin. As shown in the table, a greater fraction of the mass of the bullets constructed according to the present invention comes to rest near the entry point of the gelatin block, indicating an earlier transfer of energy to the target gelatin than conventional lead free varmint bullets. Similarly, the table shows a great fraction of the mass of the conventional lead free varmint bullets penetrate deeply into the gelatin indicating a slower transfer of energy from the conventional bullets and a great chance of passing entirely through the target, with less energy transfer to the target.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fragmenting bullet comprising:

a metal core having a generally cylindrical rear section and a tapering forward section, a plurality of spaced slots in the forward section forming a plurality of separate, spaced-apart prongs extending forwardly from the rear section and which are sized and configured to break off from the rearward section upon striking a target at least as dense as ballistic gelatin, to thereby transfer energy to the target; and a metal jacket enclosing and substantially conforming to the core, the jacket having open forward end, and a plurality of lines of weakness in the jacket over the forward section of the core.

2. The fragmenting bullet according to claim 1 wherein the core is made of cast metal.

3. The fragmenting bullet according to claim 2 wherein the core comprises cast zinc or zinc alloy.

4. The fragmenting bullet according to claim 3 wherein the jacket comprises copper or copper alloy.

5. The fragmenting bullet according to claim 4 wherein there are four spaced slots in the forward section of the core, forming four prongs.

6. The fragmenting bullet according to claim 1 wherein the jacket comprises copper or copper alloy.

7. The fragmenting bullet according to claim 1 wherein there are four spaced slots in the forward section of the core, forming four prongs.

8. The fragmenting bullet according to claim 1 further comprising an axially extending passage extending from the front of the core at least partway through the forward section.

9. The fragmenting bullet according to claim 8 wherein the rearward end of the axially extending passage is further to the rear of the core than the rearward end of the slots.

10. The fragmenting bullet according to claim 1 wherein the rearward end of the axially extending passage is forward of the rearward end of the tapering forward section of the core.

11. A fragmenting bullet comprising:

a cast metal core having a generally cylindrical rear section and a tapering forward section, a generally axially extending passage extending from the front of the core at least partway through the forward section; a plurality of spaced slots in the forward section, extending to the passageway, forming a plurality of separate, spaced-apart prongs extending forwardly from the rear section and which are sized and configured to break off from the rearward section upon striking a target at least as dense as ballistic gelatin to thereby immediately transfer energy to the target; and a metal jacket enclosing and substantially conforming to the core, the jacket having open forward end, and a plurality of lines of weakness generally aligned with the plurality of slots in the core.

12. The fragmenting bullet according to claim 11 wherein the core comprises cast zinc or zinc alloy.

13. The fragmenting bullet according to claim 12 wherein the jacket comprises copper or copper alloy.

14. The fragmenting bullet according to claim 13 wherein there are four spaced slots in the forward section of the core, forming four prongs.

15. The fragmenting bullet according to claim 11 wherein the jacket comprises copper or copper alloy.

16. The fragmenting bullet according to claim 11 wherein there are four spaced slots in the forward section of the core, forming four prongs.

17. The fragmenting bullet according to claim 14 wherein the rearward end of the axially extending passage is closer to the rear of the core than the rearward end of the slots.

18. The fragmenting bullet according to claim 14 wherein the rearward end of the axially extending passage is forward of the rearward end of the tapering forward section of the core.

19. A fragmenting bullet comprising:

a cast zinc core having a generally cylindrical rear section and a tapering forward section, a generally axially extending passage extending from the front of the core at least partway through the forward section; four equally spaced radial slots in the forward section, extending to the passageway, forming four separate, spaced-apart prongs extending forwardly from the rear section and which are sized and configured to break off from the rearward section upon striking a target at least as dense as ballistic gelatin to thereby immediately transfer energy to the target; and a copper alloy jacket enclosing and substantially conforming to the core, the jacket having open forward end, and a plurality of lines of weakness in the jacket over the forward section of the core.

20. The fragmenting bullet according to claim 19 wherein the rearward end of the axially extending passage is past the rearward end of the slots.

21. The fragmenting bullet according to claim 19 wherein the rearward end of the axially extending passage is forward of the rearward end of the tapering forward section of the core.

* * * * *